US008667887B2

(12) United States Patent
Wiedenmann et al.

(10) Patent No.: US 8,667,887 B2
(45) Date of Patent: Mar. 11, 2014

(54) ACTUATOR FOR A CLOSING ELEMENT OF A VALVE

(75) Inventors: Willi Wiedenmann, Riesbuerg (DE); Stephan Mannl, Walsassen (DE); Martin Sauer, Altisheim (DE)

(73) Assignee: KRONES AG, Neutraubling (DE)

( * ) Notice: Subject to any disclaimer, the term of this patent is extended or adjusted under 35 U.S.C. 154(b) by 516 days.

(21) Appl. No.: 13/034,802

(22) Filed: Feb. 25, 2011

(65) Prior Publication Data

US 2011/0220819 A1 Sep. 15, 2011

(30) Foreign Application Priority Data

Mar. 5, 2010 (DE) ..... 10 2010 002 621

(51) Int. Cl.
*F15B 15/06* (2006.01)

(52) U.S. Cl.
USPC ..... 92/31; 74/55; 251/58; 251/229; 251/263

(58) Field of Classification Search
USPC ..... 251/58, 229, 263; 92/31–33; 74/55
See application file for complete search history.

(56) References Cited

U.S. PATENT DOCUMENTS

| | | | | |
|---|---|---|---|---|
| 2,998,805 | A * | 9/1961 | Usab | 251/58 |
| 3,165,982 | A | 1/1965 | Taylor | |
| 3,537,358 | A * | 11/1970 | Bunyard | 92/136 |
| 4,504,038 | A * | 3/1985 | King | 251/229 |
| 4,651,626 | A * | 3/1987 | Messina | 92/13.6 |
| 4,905,574 | A * | 3/1990 | Trevisan | 92/69 R |
| 4,949,936 | A * | 8/1990 | Messina | 251/58 |
| 4,970,944 | A * | 11/1990 | Killian | 92/13.6 |
| 5,134,923 | A * | 8/1992 | Wexler | 92/13.8 |
| 6,003,432 | A * | 12/1999 | Laulhe | 92/69 R |
| 6,371,439 | B1 * | 4/2002 | Trevisan | 251/58 |
| 6,666,129 | B1 * | 12/2003 | Schmid et al. | 92/136 |
| 6,793,194 | B1 | 9/2004 | Grinberg | |
| 7,363,848 | B2 * | 4/2008 | Hoch | 92/136 |

FOREIGN PATENT DOCUMENTS

| | | |
|---|---|---|
| CN | 1245269 A | 2/2000 |
| CN | 1402817 A | 3/2003 |
| CN | 201047457 Y | 4/2008 |
| DE | 29703710 U1 | 6/1997 |
| DE | 602004001988 T2 | 9/2007 |

(Continued)

OTHER PUBLICATIONS

Notification of First Office Action, The State Intellectual Property Office of P.R. China, Application No. 201110056060.1, Dated Jun. 9, 2013.

(Continued)

*Primary Examiner* — John Bastianelli
(74) *Attorney, Agent, or Firm* — Marshall, Gerstein & Borun LLP

(57) ABSTRACT

An actuator for a rotary function element, having a housing with at least one pressure means supply and being closed at both sides by a cover, in which housing a piston is guided to reciprocate in a sealing manner, the piston containing diametrically opposed, convolution-like connecting links for a transverse axis of an actuator shaft rotatably mounted in one cover, and having two guide rods firmly anchored in the housing only at one end and engaging into guides in the piston, with the one guide rod anchored in one cover, whereas the other guide rod is anchored in the other cover, and the two guides end blind in the piston in opposite directions.

23 Claims, 2 Drawing Sheets

(56) References Cited

FOREIGN PATENT DOCUMENTS

| | | | |
|---|---|---|---|
| DE | 102008044772 | B3 | 11/2009 |
| EP | 0979952 | A2 | 2/2000 |
| EP | 1222403 | A2 | 7/2002 |
| EP | 1613848 | A1 | 1/2006 |
| EP | 1613884 | B1 | 8/2006 |
| WO | WO-2004088107 | A1 | 0/2004 |
| WO | WO-9219895 | A1 | 11/1992 |
| WO | WO-0129432 | A2 | 4/2001 |
| WO | WO-2004090403 | A1 | 10/2004 |

OTHER PUBLICATIONS

German Search Report for DE102010002621.2 dated May 20, 2010.

* cited by examiner

ACTUATOR FOR A CLOSING ELEMENT OF A VALVE

CROSS-REFERENCE TO RELATED APPLICATION

The present application claims the benefit of priority of German Application No. 102010002621.2, filed Mar. 5, 2010. The entire text of the priority application is incorporated herein by reference in its entirety.

FIELD OF THE DISCLOSURE

The disclosure relates to an actuator used for a rotary function element.

BACKGROUND

A preferred, though not restricting, field of application of such actuators is e.g. disk valves or ball cocks in the beverage bottling industry. In such disk valves or ball cocks, in at least one end position or in movements of the closing element into or out of the end position, a very high or the maximum switching torque must be often generated by the actuator, which can be subjected to pressure means, e.g. compressed air, on one side against a spring force, or on both sides.

In the generic actuator known from EP 1 222 403 A, both guide rods are loaded by the piston simultaneously and in the same manner to transmit the reaction torque from the switching torque into the housing, independent of the respective direction of the reaction torque depending on the respective direction of the stroke of the piston. Both equally long guide rods are anchored, e.g. welded, in the same cover. During the reciprocating motion of the piston, the free effective bending lengths of the guide rods change inversely to the guide lengths. The free effective bending length is the significant parameter for the bending loads or bending stresses to which the guide rod is subjected mainly in the region of the anchorage in the cover, but also in the region where it penetrates into the guide. Independent of the value of the reaction torque, the bending loads at each guide rod are highest when the free effective bending length is longest. As, depending on the construction and function of the valve controlled by the actuator, one cannot exclude that the reaction torque at the piston is highest when the free effective bending lengths at both guide rods are longest, the risk of wear in the region of the anchorages and also in the mouth regions of the guides and there at the guide rods is high. To allow for this situation, the guide rods are furthermore made of an extremely tough and expensive material in the known actuator. In addition, the piston skirt is reinforced by a metallic outer supporting tube, whereby the number of parts of the actuator is inappropriately increased. As furthermore the cover in which the two guide rods are anchored is not made of the same expensive material as the guide rods themselves for financial reasons. welding of two different materials is problematic, possibly such that no automated welding procedure can be carried out. Nevertheless, the risk of a rupture in the respective welding point remains acute, and this simultaneously in both guide rods as both guide rods are anchored in the same cover and are simultaneously subjected to the highest bending forces when their free effective bending lengths increase together during the operation of the actuator. The guide rods must also be frequently readjusted after welding so that they properly run in the guides.

In the actuator known from EP 1 613 848 B1 (DE 60 2004 001 988 T2), four guide rods are anchored in the housing. One pair of guide rods is anchored in one cover with one end, the other pair is anchored in the other cover with one end, where the free ends of the guide rods do not overlap in the direction of the stroke of the piston. Plastic slide bushes are arranged in the mouths of the guides. Depending on the direction of the reaction torque which depends on the direction of the stroke of the piston, only one pair transmits the reaction torque in the fore stroke, while the other pair transmits the opposite reaction torque in the back stroke of the piston into the housing. While the two guide rods of the one pair take up the reaction torque together, their free effective bending lengths and inversely the guide lengths change in the same manner over the stroke motion, i.e. the sum of the free effective bending lengths and the sum of the two guide lengths of these guide rods transmitting the reaction torque vary depending on the stroke of the piston. Thus, the bending loads of the guide rods are highest when their free effective bending lengths are also highest. This requires a very stable design of the anchorages of the guide rods. The four guide rods which radially have the same distances from the piston axis, which are situated diametrically opposed to each other in pairs each, where one guide rod of one pair each is placed relatively close adjacent to a guide rod of the other pair in the circumferential direction, furthermore inappropriately restrict the radian measure in the piston skirt usable for the connecting links. The actuator consists of many parts, mainly due to the four guide rods, and requires time and cost consuming manufacture.

SUMMARY OF THE DISCLOSURE

One aspect underlying the disclosure is to provide an actuator of the type mentioned in the beginning which is very fail-safe, structurally simple and nevertheless inexpensive.

As the end of the one guide rod is anchored in one cover and the end of the other guide rod is anchored in the other cover of the housing, the free effective bending length of a guide rod is a minimum in each end position of the piston, so that the bending loads and bending stresses of this guide rod are also minimal. while its guide length simultaneously is a maximum, so that the specific surface pressure between the guide and the guide rod remains low, even if the reaction moment to be transmitted then is a maximum. The guide rod whose free effective bending length is a minimum thus relieves the other guide rod of the load, whose free effective bending length then is a maximum. This altogether reduces the bending loads and bending stresses for the two guide rods, and this in the anchoring regions as well as in the mouths of the guides. This is accompanied by a reduction in wear of the guide rods in the guides. Though in the stroke motion of the piston from the respective end position, the free effective bending length of the guide rod whose free effective bending length initially was a minimum increases, the free effective bending length of the other guide rod is at the same time reduced, so that the reaction torque is transmitted without problems over the stroke distance of the piston while the bending stresses are reduced for both guide rods. The anchoring regions, e.g. welding regions, are less loaded, reducing the risk of damages and simultaneously sensibly increasing operational and process reliability, respectively. Due to the lower bending loads of the guide rods, the latter can be made of an inexpensive material, optionally of the same material as the covers. This facilitates anchorage, for example by welding. The actuator only consists of a small number of parts and can be inexpensively manufactured, as the manufacture of the anchorage region, for example, can be automated and the guide rods possibly do not require any readjustment. As in both stroke end positions of the piston, the respective reaction torque is particularly stably introduced into the housing, the values and characteristics of the torques which then must be transmitted from the actuator to the function element, e.g. the closing element of a disk valve, can be very precisely predetermined and adjusted to the switching behavior of the disk valve, for example such that the preferably plateau-like maxima of these torques are at the stroke end positions of the piston.

In one advantageous embodiment, the free ends of the two guide rods overlap in the direction of stroke. Overlapping can preferably correspond approximately to one third of the piston's outer diameter or a multiple of the thickness of the guide rods. Thereby, the guide length of the guide rod whose free effective bending length is a maximum is also relatively long and thus capable of bearing.

It is advantageous for the maximal free effective bending length of the one guide rod in a respective piston end position in the housing to correspond to between approximately half to two thirds of the piston's outer diameter and/or approximately twice the overlap of the free ends of the two guide rods. This relatively short free effective bending length reduces the bending loads of this guide rod to a moderate degree, which is anyway supported by the other guide rod which can then very stably accept loads with a minimum free effective bending length.

What is particularly important is that the sum of the guide lengths and the sum of the free effective bending lengths of both guide rods in or outside the guides is constant across the complete piston stroke, independent of the direction of the reaction torque at the piston or the direction of the stroke of the piston. This is particularly important in view of wear in the guides or at the guide rods, respectively, which is as uniform as possible and not concentrated locally.

In one appropriate embodiment, the guide rods are placed axially symmetrically and diametrically opposed with respect to the piston axis. In this manner, the reaction torque is symmetrically absorbed and transmitted into the housing.

It is furthermore advantageous for the piston to comprise a piston plate and a piston skirt containing the connecting links and the guides, where one guide has its open mouth in the piston plate and its blind end in the piston skirt, while the other guide has its open mouth in the piston skirt and its blind end in the piston plate. Although the two guide rods submerge into the piston from different sides, the design of the guides ensures that pressure cannot get from one side of the piston to the other side via the guides or connecting links, respectively. Moreover, a largely symmetric piston design with sufficient substance around those regions where forces are transmitted results from this.

In one advantageous embodiment, pressure means can act on the piston against a readjusting spring via one pressure means supply, and/or they can act from both sides via opposite pressure means supplies. In the one variant, the piston motion is performed in one stroke direction by the pressure pulse from the pressure means supply, and in the opposite direction by the readjusting spring, optionally depending either on total pressure relief in the pressure means supply, or a controlled pressure relief. Here, the actuator can be employed such that e.g. an actuated disk valve is opened by application of compressed air to the piston and closed by the readjusting, spring (normally closed=NC), or vice versa (normally open=NO). In the other case, the piston is actuated in each direction of stroke by a pressure pulse of a pressure means. e.g. compressed air.

Depending on the opening degree, e.g. of a disk valve, the torque to be transmitted depends on the angular position with respect to a zero position. Here, the torque is normally lowest within for example a 90° C. rotary adjustment between about 22° and 68°. For this, the slope of each connecting link is normally selected in both starting regions to be steeper than in an intermediate region of the connecting link, but to be equal. Practice shows, however, that for example, while compressed air acts on the piston against a readjusting spring, and the piston is returned with the readjusting spring, the torques from the displacement of the transverse axis are different in both starting regions of the connecting links. To avoid this, the slopes of the connecting links in the starting regions are appropriately selected to be steeper than in the intermediate region and to be different, so that the torque generated during spring readjustment and the torque generated during the action of compressed air at least largely have the same value. In this manner, overloads in the connecting links, the bearing of the function element and the actuator shaft and the connections of the function element in the valve can be advantageously avoided. Moreover, the same switching values or switching behaviors, respectively, always appear in different working modes, e.g. of the on-off valve actuated by the actuator, e.g. if the disk valve is designed to be opened by air but closed by a spring, or closed by air, but opened by the spring by the actuator.

In one advantageous embodiment, the angles of slope in the starting regions differ by about 2% to 10%, preferably about 5%, and the angle of slope in the intermediate section is about 60% of the angles of slope in the starting regions. Preferably, the steepest angle of slope is about 66°, the angle of slope in the intermediate region about 38.9°, and the less steep angle of slope about 63°. With this difference of the angles of slope in the two starting regions, at least to a major extent, the same torques can be generated with the action of compressed air and spring readjustment.

Here, the largest angle of slope can be provided in a starting region where in the stroke end position of the piston and at the lowest force of the readjusting spring, the transverse axis engages in the connecting link.

As the forces occurring during power transmission in the piston are also distributed over a large area and are only moderate, in an advantageous embodiment, the piston can be made of inexpensive high-density polyamide that can be easily processed. The polyamide does not require any fiber reinforcement, which, however, should not exclude to e.g. provide glass-fiber reinforcement in the piston.

Advantageously, each cover has one single mounting for a guide rod end. The guide rod is anchored with its end in the mounting by welding, screwing, shrinking, gluing or calking. Anchorage can be produced in an automated operating sequence, and thereby with high precision, so that readjustment of the anchored guide rods becomes dispensable.

Particularly advantageously, inexpensively and optimally in view of the quality of the anchorage, the guide rod is anchored with its end in the mounting of the cover by friction welding, preferably automated friction welding. The friction welding operation results in a nearly monolithic anchorage and permits to implement exact positioning and alignment of the guide rod in the cover during friction welding, so that readjustment of the guide rod can be eliminated.

Thanks to the bending loads or bending stresses of the guide rods reduced as a consequence of the construction, these can be made of an inexpensive material, e.g. of a steel of specification 1.4301 or an at least essentially similar material.

With respect to easy manufacturability, it can be advantageous to use as guide rods circular cylindrical solid material rods, and to design the guides as blind holes in the piston. This should, however, not exclude to use also hollow profiles or tubes as guide rods, and to place the latter onto pins provided at the covers and anchor them e.g. by friction welding.

BRIEF DESCRIPTION OF THE DRAWINGS

One embodiment of the subject matter of the disclosure will be illustrated with reference to the drawings. In the drawings.

DETAILED DESCRIPTION OF THE PREFERRED EMBODIMENT

Figure 1:
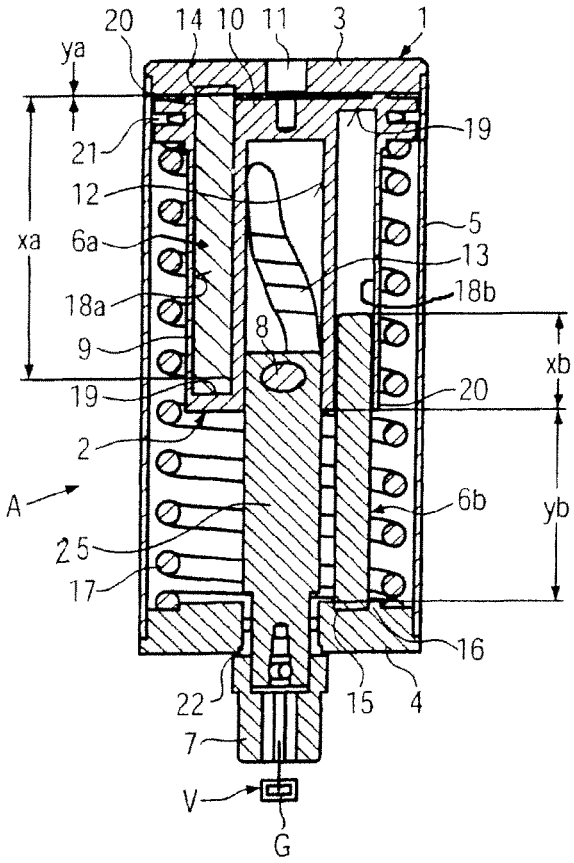
FIG. 1 shows an axial section of an actuator in an end position.

The actuator A is used, for example, for adjusting a rotary function element G by rotation. for example a closing element of a disk valve V or a ball valve, for example in the beverage bottling industry, w here the function element G requires a certain torque and progression of the torque for rotary adjustment by a certain angle of rotation (e.g. 90°) which the actuator A produces and applies. The required switching torque can be a maximum for example during the movement of the function element G into or out of an end position. In the embodiment in FIG. 1, the actuator is operated by a pressure means, for example by means of compressed air, and this in a direction of stroke against a readjusting spring, however, it could also be subjected to the pressure means from both sides, or be driven by another drive element that produces a linear motion, and generates the rotary motion for the function element G from the linear drive motion. During the actuation of the actuator A in a direction of stroke by compressed air against the readjusting spring and in the other direction by the readjusting spring, the switched valve, e.g. a disk valve, can be designed to be either closed by compressed air and opened by a spring, or closed by the spring and opened by compressed air (NC=normally closed, or NO=normally open).

The actuator A comprises a housing 1 which is in the shown embodiment for example circular cylindrical and which comprises a cylindrical sleeve 5, e.g. of metal, and upper and lower covers 3, 4, closing the sleeve 5, e.g. of a metal such as steel. The two covers 3, 4 are inserted in the sleeve 5 and fixed, for example by laser welding.

A piston 2 can be reciprocated linearly in the housing 1, in the shown embodiment adjustable in a direction of stroke against the force of a readjusting spring 17, for example by the action of compressed air via a pressure means supply 11 in the cover 3, the readjusting spring 17 being disposed between the piston 2 and the other cover 4, in the opposite direction of stroke readjustable by the readjusting spring 17 as soon as the action of compressed air is stopped or reduced.

The piston 2 can consist of metal or metal and plastics, or only of plastics, and it is appropriately made of a high-density polyamide and without fiber reinforcement. The piston 2 comprises a piston plate 10 and a piston skirt 9 integrally formed with it which surrounds an inner hollow space 12 into which the upper end of an actuator shaft 25 submerges which is rotatably mounted in the cover 4, for example by means of a bearing 22, and optionally seals. In the piston skirt 9, two e.g. convolution-like connecting links 13 are formed which are diametrically opposed with respect to the piston axis and rotate in opposite directions, and into which the ends of a transverse axis 8 fixed in the actuator shaft 25 engage. The connecting links 13 can extend in the circumferential direction over a radian measure e.g. of 90° or more or less. Its slope can be uniform or variable. Its axial length is for example longer than the total stroke of the piston 2 in the housing 1.

Via the engagement of the transverse axis 8 into the connecting links 13, the piston 2 converts its linear stroke motion into a rotary motion of the actuator shaft 25, where a constant or varying torque is generated by the actuator shaft 25 over the angle of rotation, provided that the piston 2 is prevented from performing a relative rotation about the piston axis during its stroke motions.

For the latter purpose, two guide rods 6*a*, 6*b* are installed in the actuator A which movably engage in guides 18*a*, 18*b* of the piston 2. The guide rods 6*a*, 6*b*, e.g. solid material rods having a circular cylindrical cross-section, e.g. of a steel of specification 1.4301 or an equivalent material, are parallel to each other and, just as the guides 18*a*, 18*b*, parallel to the axis of the piston 2 and to its direction of stroke. The guide rods 6*a*, 6*b* are placed e.g. with respect to the piston axis symmetrically and diametrically opposed and each anchored at one end.

The one guide rod 6*a* is anchored with its upper end for example in a deepened mounting 14 in the upper cover 3 and freely projects with its other end. In contrast, the other guide rod 6*b* is anchored with one end for example in a mounting 15 of the lower cover 4 and projects with its free end opposite to the one guide rod Ga. The free ends of both guide rods 6*a*, 6*b* overlap in a central region of the actuator A, for example with an overlap that can be somewhat shorter than a guide length xb with which the free end of the guide rod 6*b* is guided in the guide 18*b* in the shown upper end position of the piston 2. In the same operating position, however, the guide length xa of the one guide rod 6*a* in the guide 18*a* is essentially as long as the projection length of the guide rod 6*a*.

The two guides 18*a*, 18*b* are, for example, blind holes having the same shape. where the guide 18*a* has its mouth 20 in the upper side of the piston plate 10 and a blind end 19 at the lower end of the piston skirt 9. In contrast, the guide 18*b* has its open mouth 20 at the bottom side of the piston skirt 9 and its blind end 19 adjacent to the upper side of the piston plate 10 such that no pressure-transmitting communication can take place between the bottom side of the piston plate 10 and its upper side through the guides 18*a*, 18*b*. In addition, the piston plate 10 is sealed by a circumferential ring seal 21 at the inner wall of the sleeve 5. In the shown embodiment. the space underneath the piston plate 10 in which the readjusting spring 17 is arranged, can comprise a vent opening.

During the action of the piston 2 from the end position shown in FIG. 1 in the direction towards the other end position, the conversion of the linear motion into the rotary motion for the function element G, which is transmitted with a torque via a coupling end 7 of the actuator shaft 25, generates, via the connecting links 13 and the transverse axis 8, a reaction torque at the piston 2 whose direction depends on the direction of stroke. This reaction torque is forwarded from the two guide rods 6*a*, 6*b* into the housing 1, more precisely the covers 3, 4. In the process, the guide rods 6*a*, 6*b* are subjected to bending loads which must be mainly transmitted from the anchorages 16 in the mountings 14, 15, and partially also arise where the guide rods 6*a*, 6*b* enter the guides 18*a*, 18*b*.

A variable determining the extent of the bending loads of the guide rods 6*a*, 6*b* is the so-called free effective bending length of each guide rod, i.e. the length present in the transmission of the reaction torque between the mouth of the respective guide 18*a*, 18*b* and the respective anchorage 16. In the shown one end position in FIG. 1, the free effective bending length ya of the guide rod 6*a* is minimal or even zero, respectively, whereas the free effective bending length yb of the other guide rod 6*b* has a degree which corresponds, for example, to half to two thirds of the outer diameter of the piston 2 or approximately twice the guide length xb. The guide length xb can correspond, for example, to approximately one third of the piston's outer diameter, or a multiple of the strength of the guide rods 6*a*, 6*b*, e.g. approximately three times the strength.

As in the shown end position, the free effective bending length ya is a minimum or zero, respectively, only a minimum bending load arises for the guide rod 6*a* during the generation of the torque for the function element G from the reaction torque at the piston 2, that is actually only a shearing stress transverse to the longitudinal direction of the guide rod 6*a* in the space between the upper side of the piston plate 10 and the bottom side of the cover 3. The guide rod 6*a* accordingly transmits a major portion of the reaction torque into the cover 3. However, the other guide rod 6*b* also assists in that, though it is subjected to bending loads due to the free effective bending length yb, it also introduces a proportion of the reaction torque into the other cover 4 due to the guide length xb.

The sum of the guide lengths xa+xb of the two guide rods 6*a*, 6*b* in the guides 18*a*, 18*b* has a certain value which, however, remains constant over the stroke distance of the piston 2 as the guide length xb increases to the same extent as the guide length xa of the guide rod 6*a* decreases, and vice versa. The same applies to the free effective bending lengths ya, yb of which the sum ya+yb also remains constant over the stroke distance of the piston 2.

Altogether, this means that by the anchorage of the ends of the two guide rods 6*a*, 6*b* in the covers 3, 4 in opposite directions, the bending loads or bending forces for the guide rods 6*a*, 6*b* resulting from the reaction torque of the piston are reduced, in particular for the respective guide rod 6*a* or 6*b* comprising the shorter or no free effective bending length, which transmits a major portion of the reaction torque when its guide length xa or xb, respectively, is optimally long, resulting in a low specific surface pressure during the transmission of the main portion of the reaction torque, and thus reduced wear between the guide rods 6*a*, 6*b* and the guides 18*a*, 18*b*. As over the stroke distance of the piston 2, the sum of the guide lengths and the sum of the free effective bending lengths remain constant, the bending loads of the guide rods do not or hardly vary, and wear between the guide rods and the guides is also evened out or distributed over a large surface. This permits the use of an inexpensive material, for example a steel of specification 1.4301, for the guide rods 6*a*, 6*b* which can optionally also be the material of the covers 3, 4. As furthermore the sum of the guide lengths xa, xb of the two guide rods always remains constant, the piston 2 does not require any reinforcements to better absorb local load peaks.

The guide rods 6*a*, 6*b* can be welded, screwed, glued, shrunk or calked in the mountings 14, 15. A preferred way of anchoring is friction welding. To this end, (formation of the welding regions 16 in the mountings 14, 15), each guide rod is rotated in a tool under axial pressure in the mounting 15 of the cover 3, 4 until a welding procedure takes place under heat generated by friction, leading to a nearly integral and monolithic welding region 16 in which at least a considerable portion of the front end face and also a portion of the circumferential surface of the end of the respective guide rod 6*a*, 6*b* is welded with the material of the cover 3, 4. This friction welding process can be automated and offers the additional advantage of already precisely aligning the guide rod 6*a*, 6*b* with respect to the axis of the cover 3, 4 and thus the housing 1 already during friction welding, possibly making readjustment after welding dispensable. This offers advantages as to manufacture and on the one hand leads to an increase of the operational or process reliability of the actuator A due to the high quality of the welding region 16, e.g. between very similar or identical materials, and the reduced bending loads for the guide rod 6*a*, 6*b*. Moreover, an automated welding operation can be inexpensively performed; as an alternative, laser welding could also be employed.

The diameter of the piston 2 or its stroke length and the length of the housing 1 go by the cases of application and the required torques for the function element G. Different torques for the function element G can require actuators of different diameters (piston diameter), provided that an actuation by pressure means (with compressed air) is implemented, either a one-sided pressure means action against the readjusting spring 17, or as an alternative, an alternating pressure means action on both sides.

In an alternative embodiment, the two guide rods 6*a*, 6*b* could be disposed not diametrically opposed, but at arbitrarily selected angular offsets, e.g. with respect to a larger angle of rotation. The transverse axis 8 can engage in the connecting links 13 via guide shoes or sliding bearings or rolling bearings to here improve friction conditions. Furthermore, the guide rods 6*a*, 6*b* could have any arbitrary external cross-sections that fit into the guides, and/or be embodied as hollow profiles or tubes. A permanent lubrication supply could be contained in actuator A for lubricating those areas where relative motions with simultaneous power transmission take place. A tube as guide rod 6*a*, 6*b* could be, in a non-depicted alternative, placed on a pin provided at the cover 3, 4 and be anchored e.g. by frictional welding. The pin thus forms a local integrated reinforcement in the and adjacent to the anchoring region, or it could even extend over a considerable portion or the complete length of the tube. This could also be a measure to make the readjustment of the guide rods 6*a*, 6*b* dispensable.

Figure 2:
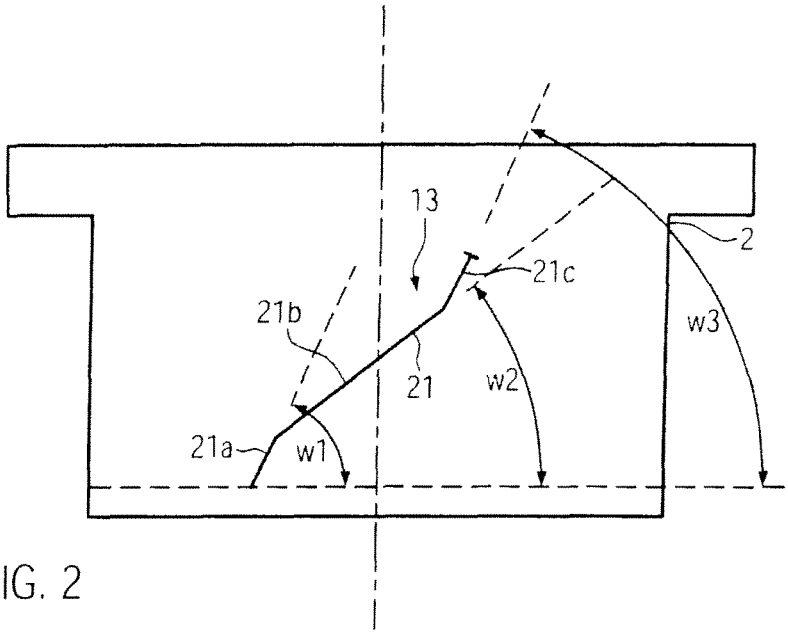
FIG. 2 shows a developed view of the outer diameter of a piston of the actuator with a characteristic progression of a connecting link.

FIG. 2 shows a developed view of the outer periphery of the piston 2 with the connecting link 13 for example only indicated with its central line 21. The connecting link 13 has starting regions 21*a*, 21*c* and an intermediate region 21*b*. The slope of the connecting link 13 (the angle included with a radial plane perpendicular to the piston axis) is greatest in the starting region 21*a* (angle of slope W1), is smallest in the intermediate region 21*b* (angle of slope W2), and is in the other starting region 21*c* greater than in the intermediate region 21*b*, however smaller than in the starting region 21*a* (angle of slope W3). In a concrete embodiment, the angle of slope WI can be approximately 66°, the angle of slope W2 approximately 39° or 38.9°, and the angle of slope W3 approximately 63°. That means, the angles of slope W1 and W3 differ by about 5%, while the angle of slope W2 only amounts to about 60% of the angles of slope W1, W2. Between the regions 21*a*, 21*b*, and 21*c*, smooth rounded transitions are provided.

In the embodiment in FIG. 1, the greatest angle of slope W1 is accordingly present, for example, in the starting region 21*a*, into which the end of the transverse axis 8 of the actuator shaft 25 engages in the shown upper stroke end position of the piston 2 as soon as the piston is subjected to pressure means via the pressure means supply 11. In contrast, the transverse axis 8 runs into the other starting region 21*c* with the somewhat smaller angle of slope W3 when the readjusting spring 17 is returning the piston 2 again into the upper stroke end position shown in FIG. 1.

Figure 3:
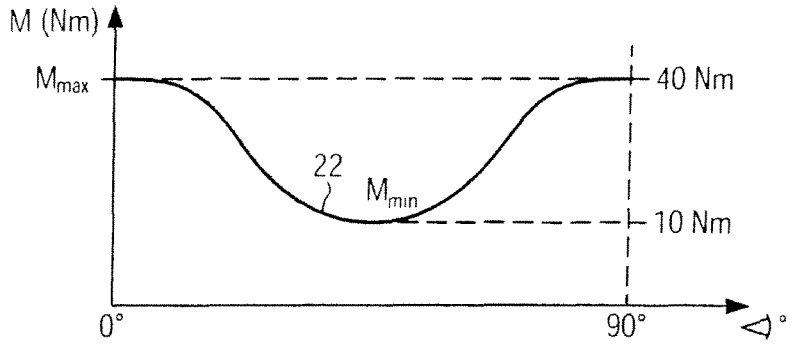
FIG. 3 shows a diagram of the progression of the torque generated by the actuator over a switching angle only by way of example selected to be 90°.

By the course of the connecting link 13 indicated in FIG. 2 (appropriately, two diametrically opposed connecting links 13 are provided in the piston skirt 9), a torque progression as it is schematically indicated in FIG. 3 is achieved during the actuation of the actuator A. On the vertical axis in FIG. 3, the torque (Nm) is indicated, while the horizontal axis represents the region of angle in degrees. A largely symmetrical torque progression (curve 22) is given where the torque reaches its maximum value $M_{max}$ each at the two end positions of the piston, these maxima being nearly plateau-like and at the same level, i.e. the torque maxima are at least approximately equal. The torque $M_{max}$ , for example, amounts to about 40 Nm, while the minimum of the torque $M_{min}$ amounts to only about 10 Nm. The reaction moment transmitted from the piston 2 to the guide rods 6*a*, 6*b* runs correspondingly, i.e. at the highest reaction moment, the then particularly stable support at the guide rods 6*a*, 6*b* is gainfully utilized. The $M_{min}$ schematically indicated in FIG. 3 could be flatter than shown arid be plateau-like.

What is claimed is:

1. Actuator (A) for a rotating function element (G), in a closing element of a disk valve or a ball valve (V), comprising a housing having at least one pressure means supply and being closed at each of two opposite ends by respective covers, in which housing a piston is guided to reciprocate in a sealing manner, which contains diametrically opposed, convolution-like connecting links for a transverse axis of an actuator shaft rotatably mounted in a cover, submerging into the piston and rotatably driven by the piston with torques in opposite directions, and having two parallel guide rods each firmly anchored in the housing only at one end, which engage in guides extending in the direction of stroke and ending blind within the piston stroke, with one of the guide rods being anchored in the cover at one of the ends of the housing and the other guide rod being anchored in the other cover, and wherein the two guides end blind in the piston in opposite directions.

2. Actuator according to claim 1, wherein the free ends of the two guide rods overlap in the direction of stroke.

3. Actuator according to claim 1, wherein the free effective bending length (ya, yb) provided in the respective piston end position of only one guide rod amounts to one of between approximately half to nearly two thirds of the piston's outer diameter, and approximately twice the overlap of the free ends of the two guide rods.

4. Actuator according to claim 1, wherein the sum of the guide lengths (xa, xb) of both guide rods in the guides is constant over the piston stroke independent of the direction of the reaction torque at the piston or the direction of stroke of the piston.

5. Actuator according to claim 1, wherein the guide rods are placed with respect to the piston axis axially symmetrically and diametrically opposed in the covers.

6. Actuator according to claim 1, wherein the piston comprises a piston plate and a piston skirt containing the connecting links and the guides, one guide having its open mouth in the piston plate and its blind end in the piston skirt, and the other guide having its open mouth in the piston skirt and its blind end in the piston plate.

7. Actuator according to claim 1, wherein the piston can be subjected in one direction of stroke to the pressure means supply against a readjusting spring, and in the other direction of stroke to the readjusting spring, and/or that the piston can be subjected from both sides to pressure means supplies disposed in the housing at opposed sides.

8. Actuator according to claim 1, wherein each connecting link comprises in starting regions different but greater angles of slope (W1, W3)—with respect to a radial plane perpendicularly going through the piston axis—than the angle of slope (W2) in an intermediate region between the starting regions.

9. Actuator according to claim 8, wherein the angles of slope (W1, W3) in the starting regions differ by about 2% to 10%, and that the angle of slope (W2) in the intermediate region amounts to about 60% of the angles of slope (W1, W3).

10. Actuator according to claim 9, wherein the greatest angle of slope (W1) is provided in the starting region in which in the stroke end position of the piston with the lowest force of the readjusting spring, the transverse axis engages.

11. Actuator according to claim 1, wherein the piston is made of high-density polyamide.

12. Actuator according to claim 1, wherein each cover comprises a mounting for a guide rod end which is either depressed or pin-shaped, and that the guide rods are inserted into the mountings or placed onto the mountings and one of welded, screwed, shrunk, glued or calked.

13. Actuator according to claim 12, wherein the respective guide rod is anchored in or on the mounting of the cover by friction welding.

14. Actuator according to claim 1, wherein at least the guide rods consist of a steel of specification 1.4301 or a metal alloy comparable to this specification.

15. Actuator according to claim 1, wherein the guide rods are equally dimensioned, circular cylindrical solid material rods or tubes and the guides are blind holes.

16. Actuator according to claim 2, wherein the overlap approximately corresponds to one third of the piston's outer diameter.

17. Actuator according to claim 4, wherein the sum of the free effective bending lengths of both guide rods in the guides is constant over the piston stroke independent of the direction of the reaction torque at the piston or the direction of stroke of the piston.

18. Actuator according to claim 8, and wherein the torques transmitted from the actuator shaft to the function element (G) by the engagement of the transverse axis in the starting regions at least approximately have the same maxima ($M_{max}$), independent of the action of pressure means or the readjusting spring on the piston.

19. Actuator according to claim 9, and wherein the angles of slope (W1, W3) in the starting regions differ by about 5%.

20. Actuator according to claim 9, and where the angle of slope (W1) amounts to about 66°, the angle of slope (W2) amounts to one of approximately 40° or 38.9°, and the angle of slope (W3) amounts to about 63°.

21. Actuator according to claim 11, wherein the high-density polyamide is without fiber reinforcement.

22. Actuator according to claim 13, wherein the friction welding is automated friction welding.

23. Actuator according to claim 13, wherein the friction welding is at the front side and the outer or inner periphery, in a welding region.

* * * * *